US010459384B2

(12) United States Patent
Tanaka et al.

(10) Patent No.: US 10,459,384 B2
(45) Date of Patent: Oct. 29, 2019

(54) FUSER INCLUDING BELT AND SLIDING SHEET

(71) Applicant: Brother Kogyo Kabushiki Kaisha, Nagoya-shi, Aichi-ken (JP)

(72) Inventors: Tokifumi Tanaka, Komaki (JP); Hideki Kanada, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/137,664

(22) Filed: Sep. 21, 2018

(65) Prior Publication Data

US 2019/0235426 A1 Aug. 1, 2019

(30) Foreign Application Priority Data

Jan. 31, 2018 (JP) ..... 2018-014459

(51) Int. Cl.
*G03G 15/20* (2006.01)

(52) U.S. Cl.
CPC ..... *G03G 15/2057* (2013.01); *G03G 15/2064* (2013.01)

(58) Field of Classification Search
USPC ..... 399/331
See application file for complete search history.

(56) References Cited

U.S. PATENT DOCUMENTS

| | | | |
|---|---|---|---|
| 7,379,697 | B2 | 5/2008 | Ito et al. |
| 8,032,068 | B2 | 10/2011 | Hanyu et al. |
| 8,195,072 | B2 | 6/2012 | Okuno |
| 8,909,116 | B2 | 12/2014 | Ohtsu |
| 8,958,733 | B2 | 2/2015 | Nishida et al. |
| 9,002,254 | B2 | 4/2015 | Ohtsu |
| 9,008,560 | B2 | 4/2015 | Otsu |
| 2006/0083567 | A1 | 4/2006 | Ito et al. |
| 2009/0014942 | A1 | 1/2009 | Okuno |
| 2009/0208263 | A1 | 8/2009 | Hanyu et al. |
| 2013/0189007 | A1 | 7/2013 | Ohtsu |
| 2013/0266354 | A1 | 10/2013 | Nishida et al. |
| 2014/0086651 | A1 | 3/2014 | Otsu |
| 2014/0205332 | A1 | 7/2014 | Otsu |
| 2015/0030362 | A1 | 1/2015 | Bae et al. |
| 2016/0274519 | A1 | 9/2016 | Lim et al. |
| 2017/0097598 | A1 | 4/2017 | Kudo et al. |

(Continued)

FOREIGN PATENT DOCUMENTS

| | | | |
|---|---|---|---|
| JP | 2003-076178 | A | 3/2003 |
| JP | 2004-37552 | A | 2/2004 |

(Continued)

OTHER PUBLICATIONS

Sep. 21, 2018—Co-Pending U.S. Appl. No. 16/137,646.

(Continued)

*Primary Examiner* — Quana Grainger
(74) *Attorney, Agent, or Firm* — Banner & Witcoff, Ltd.

(57) ABSTRACT

A fuser may include a rotatable member, a belt, a pressure member, and a sliding member. The belt and rotatable member may form a nip portion. The sliding member may be sandwiched between an inner peripheral surface of the belt and the pressure member. The sliding member may include a front surface, which faces the inner peripheral surface of the belt. The front surface may include a plurality of dimples designed to catch lubricant that moves along ridges between the dimples.

20 Claims, 13 Drawing Sheets

(56) References Cited

U.S. PATENT DOCUMENTS

| | | | |
|---|---|---|---|
| 2017/0176905 | A1 | 6/2017 | Suzuki et al. |
| 2017/0285537 | A1 | 10/2017 | Onaka et al. |
| 2018/0292771 | A1 | 10/2018 | Kudo et al. |
| 2018/0299808 | A1 | 10/2018 | Suzuki et al. |

FOREIGN PATENT DOCUMENTS

| | | | |
|---|---|---|---|
| JP | 2006-119263 | A | 5/2006 |
| JP | 2007-147865 | A | 6/2007 |
| JP | 2009-15227 | A | 1/2009 |
| JP | 2009-198567 | A | 9/2009 |
| JP | 2009-229494 | A | 10/2009 |
| JP | 2013-148837 | A | 8/2013 |
| JP | 2013-218175 | A | 10/2013 |
| JP | 2014-63067 | A | 4/2014 |
| JP | 2014-139641 | A | 7/2014 |

OTHER PUBLICATIONS

Sep. 21, 2018—Co-Pending U.S. Appl. No. 16/137,672.
Feb. 7, 2019—U.S. Non-Final Office Action—U.S. Appl. No. 16/137,672.
Apr. 8, 2019—U.S. Notice of Allowance—U.S. Appl. No. 16/137,646.
Aug. 19, 2019—U.S. Non-final Office Action—U.S. Appl. No. 16/137,672.

FUSER INCLUDING BELT AND SLIDING SHEET

CROSS-REFERENCE TO RELATED APPLICATION

This application claims priority from Japanese Patent Application No. 2018-014459 filed on Jan. 31, 2018, the content of which is incorporated herein by reference in its entirety.

FIELD OF DISCLOSURE

Aspects disclosed herein relate to systems and methods for fusing a toner image onto a recording medium.

BACKGROUND

A known fuser includes a heat roller, a nip forming member, and a sliding sheet. The nip forming member and the heat roller sandwich an endless belt therebetween to form a nip portion. The sliding sheet is disposed between a portion of an inner circumferential surface of the endless belt and the nip forming member. The sliding sheet has a surface that contacts a portion of the inner circumferential surface of the endless belt. The surface of the sliding sheet has a plurality of dimples for reducing sliding resistance occurring between the surface of the sliding sheet and the endless belt during rotation of the endless belt. The dimples are aligned in a plurality of lines with respect to one direction. The sliding sheet thus has particular portions each straightly extending along the one direction from one end to the other end of the sliding sheet between the dimple edges.

Lubricant may be applied to the inner circumferential surface of the endless belt. Nevertheless, the particular portions, each of which straightly extend along the one direction from one end to the other end of the sliding sheet between the dimple lines, may cause lubricant to move along the particular portions from the one end toward the other end of the sliding sheet and off edges of the sliding sheet. Because of these particular portions, the sliding sheet might not retain as much lubricant as desired. As a result of the loss of lubricant between the sliding sheet and endless belt, a resistance between the sliding sheet and the inner circumferential surface of the endless belt may increase.

SUMMARY

A fuser may include a rotatable member, a belt, a pressure member, and a sliding member. The belt and rotatable member may form a nip portion. The sliding member may be sandwiched between an inner peripheral surface of the belt and the pressure member. The sliding member may include a front surface, which faces the inner peripheral surface of the belt. The front surface may include a plurality dimples designed to catch lubricant that moves along ridges between the dimples. For example, the dimples may be arranged at a predetermined area corresponding to at least part of the nip portion. In some embodiments, the dimples may include a first dimple and a second dimple that are adjacent to each other and spaced to form a ridge portion. A third dimple may be arranged to catch the lubricant that moves along this ridge portion. For example, the third dimple may be arranged to intersect all imaginary lines that pass between the first and second dimples and that pass through the ridge portion.

In one aspect of the present disclosure, the dimples may be arranged in a honeycomb lattice. And, each of the dimples may have a hexagonal shape opening. In other aspects of the present disclosure, different arrangements of the dimples may be employed and the dimples may have openings with different shapes.

In another aspect of the present disclosure, the front surface of the sliding member may include a contact surface in contact with the inner peripheral surface at a position corresponding to the nip portion. The total area percentage of the contact surface may be equal to or less than 50% of the front surface at the position corresponding to the nip portion.

In yet another aspect of the present disclosure, the dimples may have certain sizes and shapes. For example, a dimple may have a size and shape, such that a diameter of an imaginary inscribed circle that is tangent to each edge of the dimple is greater than a width of a ridge portion between the dimple and an adjacent dimple.

BRIEF DESCRIPTION OF THE DRAWINGS

Aspects of the present disclosure are illustrated by way of example and not by limitation in the accompanying figures in which like reference characters indicate similar elements.

DETAILED DESCRIPTION

Illustrative embodiments will be described with reference to the accompanying drawings. Hereinafter, an explanation will be provided with reference to directions, top, bottom, front, and rear, as defined in FIG. 1. The right and left of the color printer 1 are defined as viewed from the front of a laser printer 1. These directions will be used throughout the following explanation.

Figure 1:
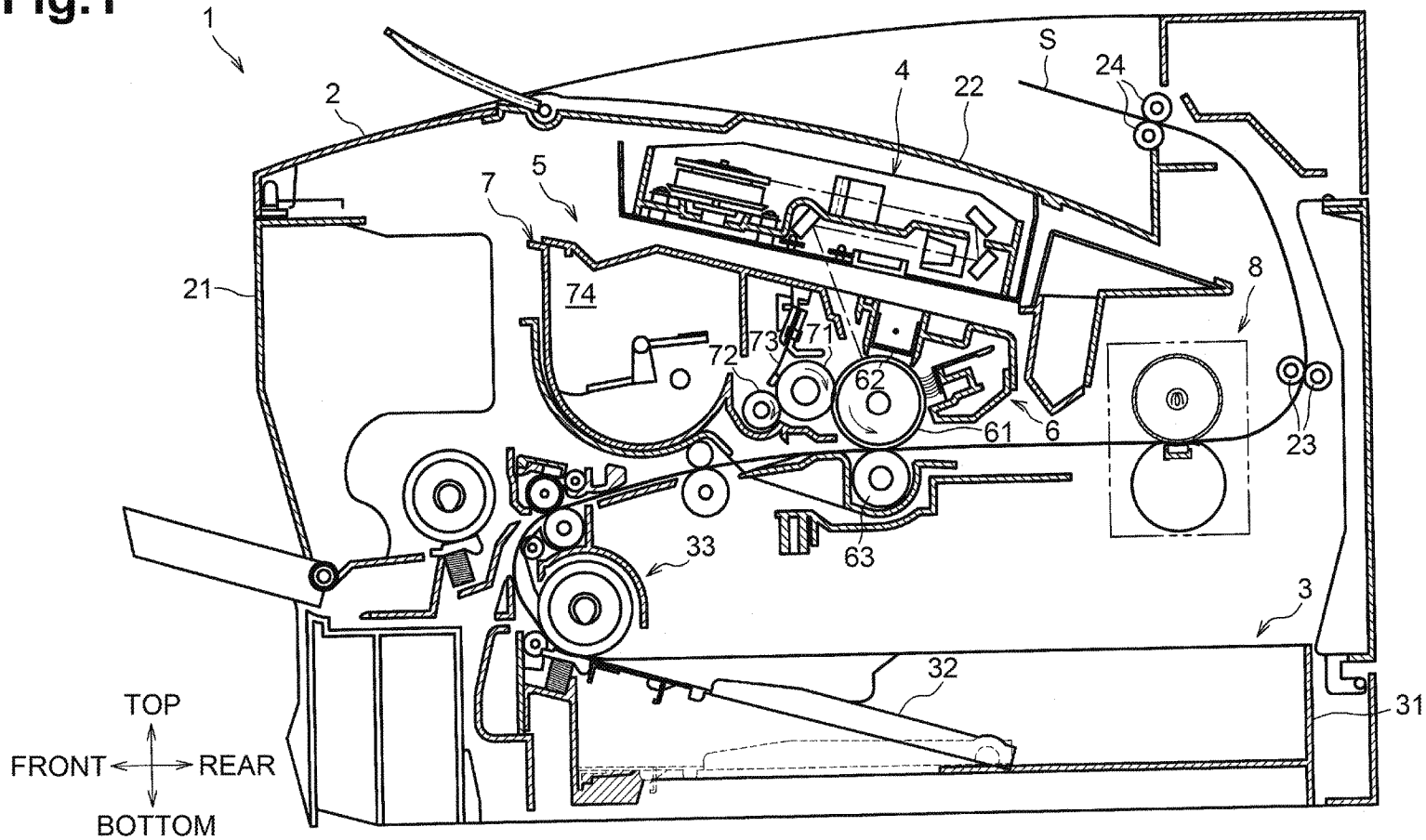
FIG. 1 is a sectional view illustrating a laser printer in an illustrative embodiment according to one or more aspects of the present disclosure.

As illustrated in FIG. 1, the laser printer 1 includes a housing 2. The laser printer 1 further includes a feed unit 3, an exposure device 4, a process cartridge 5, and a fuser 8 in the housing 2.

The feed unit 3 may be disposed in a lower portion of the housing 2. The feed unit 3 includes a feed tray 31, a sheet support plate 32, and a sheet feed mechanism 33. The feed tray 31 may be configured to accommodate one or more sheets S. The sheet support plate 32 may be configured to raise the one or more sheets S in the feed tray 31. The sheet feed mechanism 33 may be configured to feed, one by one, the raised one or more sheets S to the process cartridge 5.

The exposure device 4 may be disposed in an upper portion of the housing 2. The exposure device 4 includes a light emitter, a polygon mirror, lenses, and reflectors. In the exposure device 4, the light source emits a laser beam based on image data to scan (e.g., at high speed) an outer circumferential surface of a photosensitive drum 61, thereby exposing a portion of the outer circumferential surface of the photosensitive drum 61.

The housing 2 forms an opening. The housing 2 further includes a front cover 21 for covering the opening. The process cartridge 5 may be detachably attachable to the housing 2 through the opening that may be exposed when the front cover 21 may be open. In a state where the process cartridge 5 may be attached to the housing 2, the process cartridge 5 may be placed below the exposure device 4. The process cartridge 5 includes a drum unit 6 and a developing unit 7. The drum unit 6 includes the photosensitive drum 61, a charger 62, and a transfer roller 63. The developing unit 7 may be detachably attachable to the drum unit 6. The developing unit 7 includes a developing roller 71, a supply roller 72, a blade 73, and a storage 74 for storing toner.

In the process cartridge 5, the charger 62 aims to uniformly charge the outer circumferential surface of the photosensitive drum 61. The photosensitive drum 61 may be then formed with an electrostatic latent image on its outer circumferential surface based on image data by exposure with a laser beam by the exposure device 4. The supply roller 71 supplies toner onto an outer circumferential surface of the developing roller 71 from the storage 74. The blade 73 reduces the toner into a thin layer having uniform thickness. The developing roller 71 thus holds the thin layer of toner on its outer circumferential surface. The developing roller 71 further supplies toner onto the electrostatic latent image formed on the outer circumferential surface of the photosensitive drum 61. The photosensitive drum 61 thus holds a toner image which may be a visualized electrostatic latent image, on its outer circumferential surface. Thereafter, the transfer roller 63 transfers the toner image onto a sheet S from the outer circumferential surface of the photosensitive drum 61 when the sheet S passes between the photosensitive drum 61 and the transfer roller 63.

The fuser 8 may be disposed behind the process cartridge 5. The fuser 8 may be configured to fuse the toner image onto the sheet S when the sheet S passes through the fuser 8. The laser printer 1 further includes a discharge tray 22 and conveying rollers 23 and 24. The conveying rollers 23 and 24 are configured to convey the sheet S having the toner image fused thereon to discharge the sheet S onto the discharge tray 22.

Figure 2A:
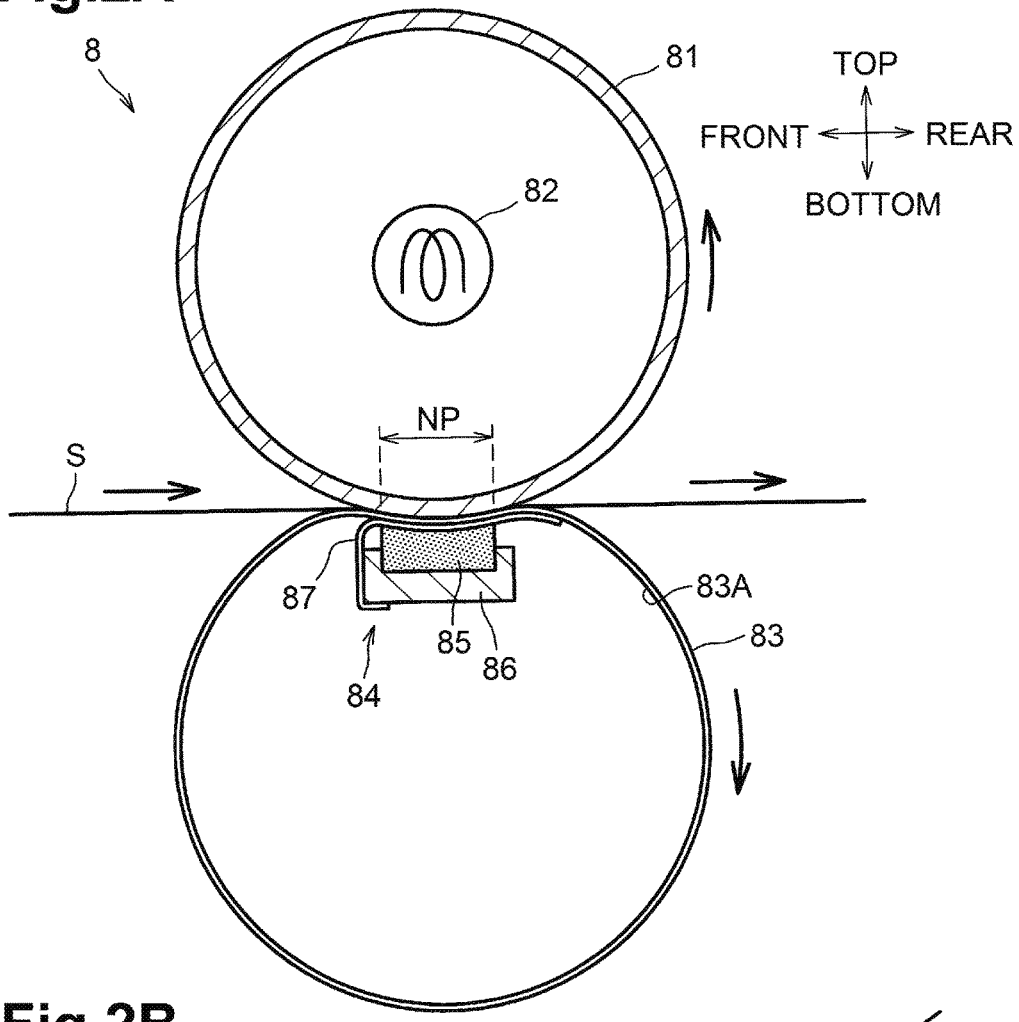
FIG. 2A is a cross sectional view illustrating a fuser in the illustrative embodiment according to one or more aspects of the present disclosure.

As illustrated in FIG. 2A, the fuser 8 includes a heat roller 81, a heater 82, an endless belt 83, and a pressure unit 84. The heat roller 81 may be an example of a rotatable member. At least one of the heat roller 81 and the pressure unit 84 may be urged toward the other to form a nip portion NP between the heat roller 81 and the endless belt 83.

In the following explanation, a direction in which the endless belt 83 extends along its rotational axis may be referred to as a "width direction". A direction in which the endless belt 83 moves at the nip portion NP when the fuser 8 fuses a toner image onto a sheet S may be referred to as a "moving direction". A direction in which the heat roller 81 and the pressure unit 84 (more specifically, a pressure pad 85) face each other may be referred to as a "facing direction". In the illustrative embodiment, the width direction extends parallel to an axis of the heat roller 81 and corresponds to a right-left direction of the laser printer 1. The moving direction corresponds to a front-rear direction of the laser printer 1. The facing direction corresponds to a top-bottom direction of the laser printer 1.

The heat roller 81 may include a hollow cylindrical body. For example, the heat roller 81 may include a base tube made of metal such as aluminum. The base tube may have a release layer formed on its outer circumferential surface. The release layer may be made of, for example, fluorine resin. The heat roller 81 may be configured to receive a driving force transmitted from a motor (not illustrated in FIG. 2) to rotate counterclockwise in FIG. 2. The heat roller 81 may be in contact with a portion of an outer circumferential surface of the endless belt 83.

The heater 82 may be configured to heat the heat roller 81. The heater 82 may be disposed in an internal space of the heat roller 81. The heater 82 may be, for example, a halogen lamp that emits light by energization to heat the heat roller 81 by its radiant heat.

The endless belt 83 may be a flexible cylindrical member. The endless belt 83 may include, for example, a base made of metal such as stainless steel or resin such as polyimide resin. The base may have a release layer formed on its outer circumferential surface. The release layer may be made of fluorine resin. The endless belt 83 may be configured to rotate clockwise in FIG. 2 by rotation of the heat roller 81.

The endless belt 83 has an inner circumferential surface 83A which may be lubricated by lubricant such as grease. The lubricant may increase slidability between the inner circumferential surface 83A of the endless belt 83 and the pressure unit 84. This may thus enable the endless belt 83 to rotate smoothly relative to the pressure unit 84.

The pressure unit 84 includes the pressure pad 85, a holder 86, and a sliding sheet 87. The holder 86 holds the pressure pad 85. The pressure pad 85 may be an example of a nip forming member having a nip surface.

The pressure pad 85 may be disposed inside a loop of the endless belt 83. That is, the pressure pad 85 may be surrounded by the endless belt 83. The pressure pad 85 may include an elastic member made of, for example, rubber. The pressure pad 85 and the heat roller 81 sandwich a portion of the endless belt 83 to form the nip portion NP therebetween. This configuration may thus enable application of heat and pressure to a sheet S having a toner image while the sheet S passes the nip portion NP, thereby fusing the toner image onto the sheet S.

The sliding sheet 87 may have a rectangular shape. The sliding sheet 87 may be used for reducing friction resistance occurring between the pressure pad 85 and the endless belt 83 when the endless belt 83 rotates. The sliding sheet 87 may be sandwiched between the inner circumferential surface 83A of the endless belt 83 and the pressure pad 85 at the nip portion NP. For example, the sliding sheet 87 has one end (e.g., an upstream end) attached to an upstream end portion (e.g., front-facing portion), in the moving direction, of the holder 86. More specifically, for example, the sliding sheet 87 extends upward along an external shape of the upstream end portion of the holder 86 in the moving direction from a lower surface of the holder 86, and bends toward the rear. The sliding sheet 87 further extends over the holder 86 while being disposed between the pressure pad 85 and the endless belt 83.

In the illustrative embodiment, the other end (e.g., a downstream end) of the sliding sheet 87 is not fixed. Nevertheless, in other embodiments, for example, the other end of the sliding sheet 87 may also be fixed to the holder 86 (e.g., a downstream/rear-facing end portion or bottom-facing portion of the holder 86). In the illustrative embodiment, the sliding sheet 87 may be made of, for example, resin including polyimide. Nevertheless, in other embodiments, any material may be used for the sliding sheet 87.

Figure 2B:
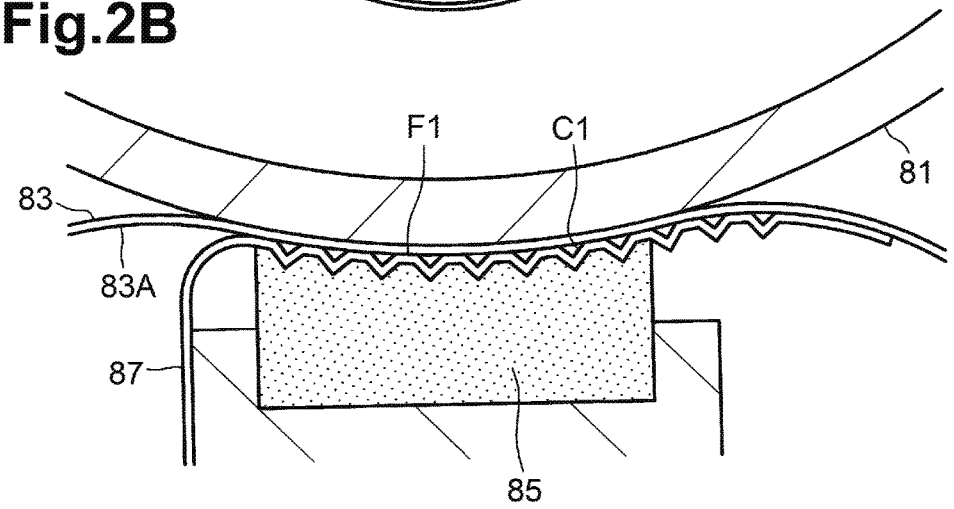
FIG. 2B is an enlarged view illustrating a nip portion and its surrounding portion in the illustrative embodiment according to one or more aspects of the present disclosure.
Figure 3:
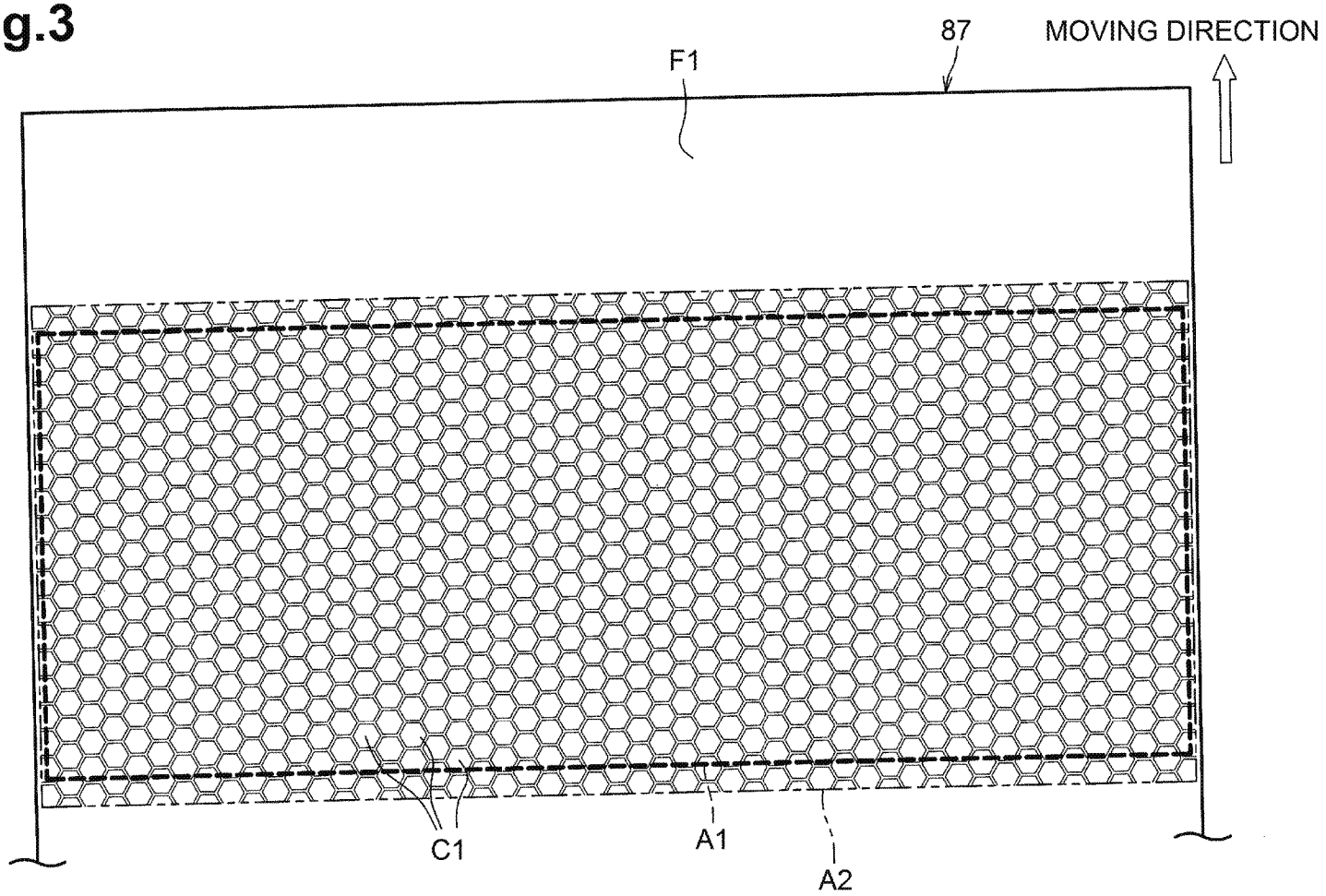
FIG. 3 illustrates a sliding sheet having a plurality of dimples thereon in the illustrative embodiment according to one or more aspects of the present disclosure.

As illustrated in FIG. 2B, the sliding sheet 87 has a surface F1 which may contact a portion of the inner circumferential surface 83A of the endless belt 83. The surface F1 of the sliding sheet 87 has a plurality of dimples C1. More specifically, for example, as illustrated in FIG. 3, the surface F1 includes a section A1, which may include most of the dimples C1. The dimples C1 included in the section A1 may occupy the section A1 entirely and may be arranged in a regular pattern. The section A1 of the surface F1 corresponds to the nip portion NP. More specifically, the section A1 may receive a nip pressure applied by the heat roller 81. The section A1 may have a size of, for example, 10 mm in the front-rear direction and 230 mm in the width direction. In the illustrative embodiment, the surface F1 further includes a section A2 including all of the dimples C1. The section A2 may have at least an equal dimension as the section A1 in the width direction and may have a greater dimension than the section A1 in the moving direction. That is, the section A2 may have upstream and downstream ends that protrude relative to upstream and downstream ends, respectively, of the section A1 in the moving direction.

In one example, the dimples C1 in section A2 might only form a part of surface F1. In another example, the dimples C1 in section A2 might be formed throughout the entire surface F1. In still another example, the section A2 may be included within the section A1. In such a case, for example, the section A2 may be greater than the section A1 in the width direction.

The surface F1 has particular portions that may contact the endless belt 83. The particular portions of the surface F1 have a total area percentage of 50% or less relative to an area of the section A1 of the sliding sheet 87. The area of the section A1 may be determined without consideration of the surface unevenness. That is, it may be regarded that the section A1 may be a flat surface.

The pressure pad 85 may be preferably made of a material, e.g., rubber, softer than the material used for the sliding sheet 87. This may enable each dimple C1 to retain its shape against pressure exerted on the sliding sheet 87 by the pressure pad 85.

Figure 4A:
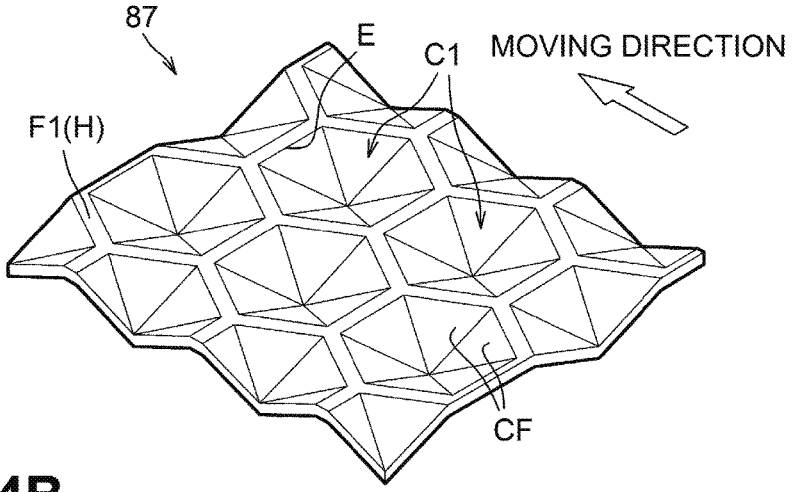
FIG. 4A is an enlarged perspective view illustrating a portion of the sliding sheet including some of the plurality of dimples in the illustrative embodiment according to one or more aspects of the present disclosure.

As illustrated in FIG. 4A, each dimple C1 has an opening E having a regular hexagonal shape when viewed in a direction perpendicular to the surface F1. Each dimple C1 may be defined by a plurality of, for example, six, triangular surfaces CF to form in a hexagonal pyramid shape. The opening E of each dimple C1 may be defined by edges, each of which may be one of edges of each triangular surface CF. The dimples C1 all have the same shape and size. The dimples C1 may be spaced from each other by a predetermined distance and arranged in a honeycomb lattice. In the following explanation, the particular portions of the surface F1 defined between adjacent dimples C1 may be referred to as ridges H. Each ridge H has a flattened top. Each ridge H has a width (e.g., a distance between facing edges of adjacent dimples C1) smaller than a diameter of an inscribed circle that may be tangent to each edge of the hexagonal opening E. In the illustrative embodiment, the dimples C1 are embossed on the surface F1. Nevertheless, the method for forming the dimples C1 might not be limited to the specific example and any method may be applicable.

Figure 4B:
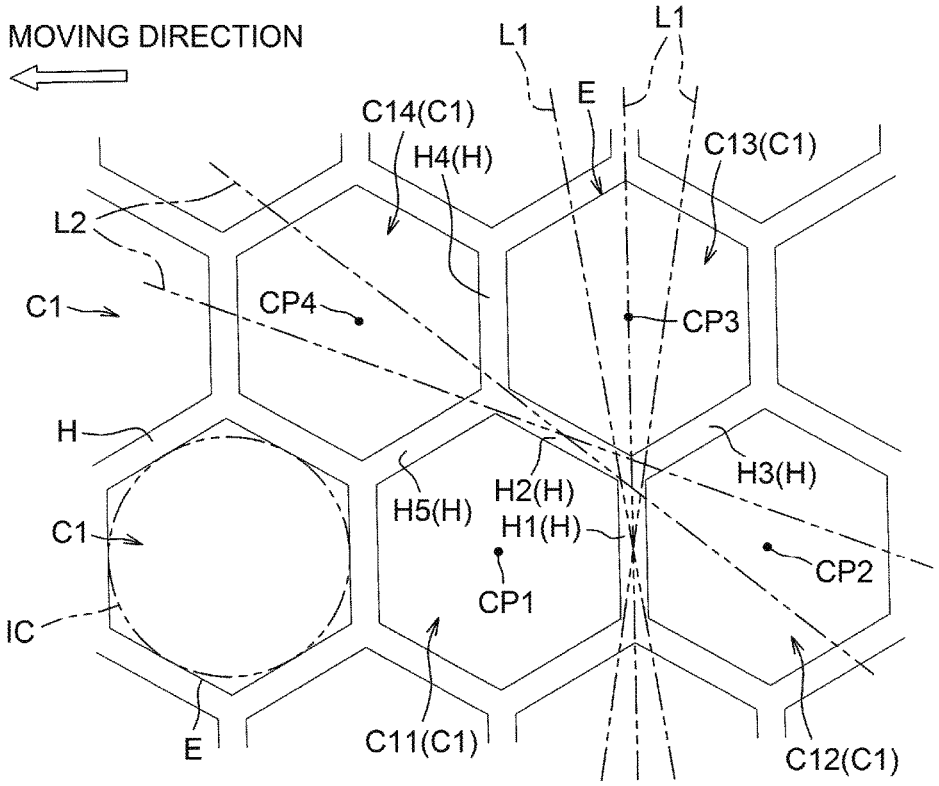
FIG. 4B is an enlarged plan view illustrating some of the plurality of dimples in the illustrative embodiment according to one or more aspects of the present disclosure.

As illustrated in FIG. 4B, it may be assumed that a plurality of imaginary straight lines L1 pass between two arbitrary adjacent dimples (e.g., a dimple C11 and a dimple C12) of the dimples C1. Each dimple C1 may be located such that all of the imaginary straight lines L1 passing between two arbitrary adjacent dimples of the dimples C1 intersect at least one of the dimples C1. The two arbitrary adjacent dimples of the dimples C1 are located on opposite sides of a single straight ridge H.

The imaginary straight lines L1 include any imaginary straight lines that pass between two adjacent dimples of the dimples C1 and are included in a particular range that may be defined between one imaginary straight line L1 inclined toward upstream in the moving direction by the maximum permissible degree without intersecting the two adjacent dimples and another imaginary straight line L1 inclined toward downstream in the moving direction by the maximum permissible degree without intersecting the two adjacent dimples. All of the imaginary straight lines L1, each of which may be inclined toward upstream or downstream while passing between the two adjacent dimples C1 in the particular range, intersect one of the dimples C1.

For example, the surface F1 has a ridge H1 between adjacent two (e.g., the dimple C11 and the dimple C12) of the dimples C1. The dimple C11 may be determined arbitrarily and the dimple C12 may be adjacent to the dimple C11 in the moving direction. The ridge H1 extends along the width direction. More specifically, for example, the ridge H1 has a greater dimension in the width direction than its dimension in the moving direction. The dimples C1 further include a dimple C13. The dimple C13 may be located intersecting all imaginary straight lines L1, each of which passes through the ridge H1 while extending parallel to the top surface of the ridge HE The imaginary straight lines L1 do not intersect either of the dimple C11 and the dimple C12.

The dimple C13 may be located adjacent to both of the dimple C11 and the dimple C12 in the width direction. The surface F1 further has a ridge H2 between the dimple C13 and the dimple C11.

The dimples C1 further include a dimple C14 that may be located adjacent to both of the dimple C13 and the dimple C11. It may be assumed that a plurality of imaginary straight lines L2 pass through the ridge H2 while extending parallel to the top surface of the ridge H2. The imaginary straight lines L2 do not intersect either of the dimple C11 and the dimple C13. The dimple C14 may be located intersecting all of the imaginary straight lines L2. Each imaginary straight line L2 intersects all of the imaginary straight lines L1.

The dimples C1 may be arranged in a regular pattern. Thus, every arbitrary adjacent four (e.g., the dimple C11, the dimple C12, the dimple C13, and the dimple C14) may establish such a positional relationship.

The dimple C11, the dimple C12, and the dimple C13 have a center CP1, a center CP2, and a center CP 3, respectively. The dimple C11, the dimple C12, and the dimple C13 are located to form a triangle having their centers CP1, CP2, and CP3 as its vertices. The dimple C14 also has a center CP4. Likewise, the dimple C11, the dimple C13, and the dimple C14 are located to form a triangle having their centers CP1, CP3, and CP4 as its vertices.

The dimple C11 and the dimple C12 are located on opposite sides of the ridge H1 and adjacent to each other in the moving direction. The dimple C13 may be located adjacent to both of the dimple C11 and the dimple C12 in the width direction. The surface F1 further has a ridge H3 between the dimple C13 and the dimple C12. More specifically, for example, the dimple C13 may be located across the ridge H2 from the dimple C11 and across the ridge H3 from the dimple C12. The dimple C14 and the dimple C13 are located adjacent to each other in the moving direction. The surface F1 further has a ridge H4 between the dimple C14 and the dimple C13. The dimple C14 may be located adjacent to the dimple C11 in the width direction. The surface F1 further has a ridge H5 between the dimple C14 and the dimple C11.

Figure 5:
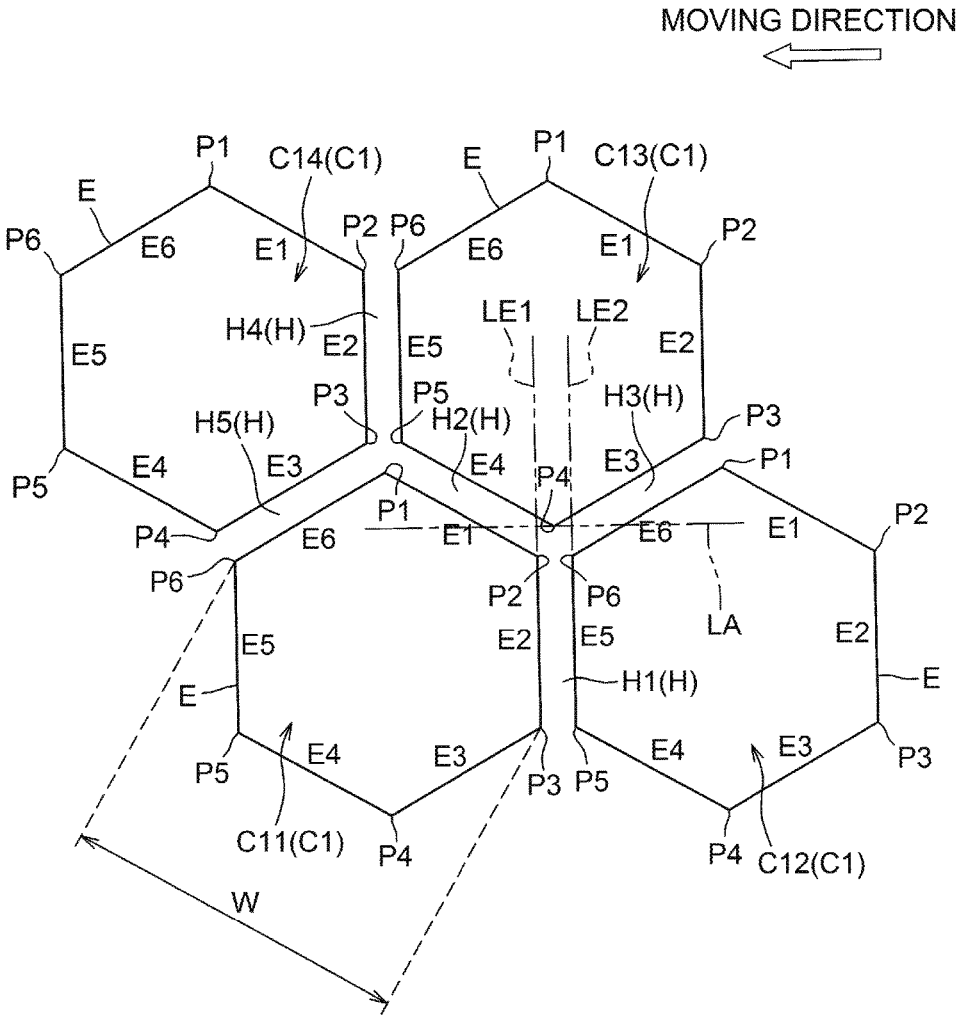
FIG. 5 is a plan view for explaining a positional relationship between adjacent dimples in the illustrative embodiment according to one or more aspects of the present disclosure.

As illustrated in FIG. 5, each opening E may be defined by straight edges, e.g., an edge E1, an edge E2, an edge E3, an edge E4, an edge E5, and an edge E6. The edge E1 and the edge E4 extend parallel to each other. The edge E2 and the edge E5 extend parallel to each other. The edge E3 and the edge E6 extend parallel to each other.

The edge E2 and the edge E5 both extend in the width direction. The edge E1 has one end that connects one end of the edge E2. The edge E3 has one end that connects the other end of the edge E2.

The edge E6 has one end that connects one end of the edge E5 and the other end that connects the other end of the edge E1. The edge E4 has one end that connects the other end of the edge E5 and the other end that connects the other end of the edge E3.

The opening E has a vertex P1, a vertex P2, a vertex P3, a vertex P4, a vertex P5, and a vertex P6. The vertex P1 may be located where the edge E1 and the edge E6 connect each other. The vertex P2 may be located where the edge E1 and the edge E2 connect each other. The vertex P3 may be located where the edge E2 and the edge E3 connect each other. The vertex P4 may be located where the edge E3 and the edge E4 connect each other. The vertex P5 may be located where the edge E4 and the edge E5 connect each other. The vertex P6 may be located where the edge E5 and the edge E6 connect each other.

The edge E2 of the dimple C11 may be a boundary between the dimple C11 and the ridge HE The edge E5 of the dimple C12 may be a boundary between the dimple C12 and the ridge HE The dimple C13 intersects an imaginary extension line LE1 of the edge E2 of the dimple C11 and an imaginary extension line LE2 of the edge E5 of the dimple C12. The vertex P4 of the opening E of the dimple C13 may be located closer to the ridge H1 than the other vertices P1, P2, P3, P5, and P6 of the opening E of the dimple C13 and may be located between the imaginary extension line LE1 and the imaginary extension line LE2.

The opening E of each dimple C1 may have a width W of, for example, between 0.5 mm and 5 mm. The width W may be a distance between two vertices that are farthest apart. Each dimple C1 may have a depth of, for example, between 0.1 mm and 1 mm Each ridge H may have a width of, for example, between 0.1 mm to 1 mm.

The illustrative embodiment may thus achieve the following effects. The dimple C13 may be located intersecting all of the imaginary straight lines L1 that pass through the ridge H1 defined between the dimple C11 and the dimple C12. This arrangement may enable the dimple C13 to catch lubricant moving along the ridge H1, thereby retaining lubricant between the sliding sheet 87 and the endless belt 83 sufficiently. Consequently, this may reduce the change (e.g., increase) of the sliding resistance between the sliding sheet 87 and the inner circumferential surface 83A of the endless belt 83.

The dimple C14 may be located intersecting all of the imaginary straight lines L2 that pass through the ridge H2 defined between the dimple C11 and the dimple C13. This arrangement may enable the dimple C14 to catch lubricant moving along the ridge H2, thereby retaining lubricant between the sliding sheet 87 and the endless belt 83 sufficiently.

In the illustrative embodiment, the ridge H1 extends along the moving direction, and thus, the ridge H1 has a shorter dimension in the moving direction than its dimension in the width direction. This configuration may enable lubricant supplied from the dimple C12 located upstream from the ridge H1 in the moving direction to be spread over the ridge H1 more easily as compared with a case where a first ridge extends along the width direction, thereby always sufficiently lubricating the entire portion of the ridge HE If some of the lubricant supplied from the dimple C12 moves further from the one end of the ridge H1 in the width direction, the lubricant may move along the ridge H2 and then be caught by the dimple C14. Likewise, if some of the lubricant supplied from the dimple C12 moves further from the other end of the ridge H1 in the width direction, the lubricant may move along a ridge H located adjacent to the dimple C11 in the width direction and then be caught by another dimple C1 located downstream from the ridge H in the moving direction. Such an arrangement pattern may thus enable each dimple C1 to hold lubricant therein sufficiently.

The dimple C11 and the dimple C12 are located intersecting an imaginary straight line LA. This arrangement may enable the ridge H2 and the ridge H3 to have a relatively small area, thereby reducing the contact area between the sliding sheet 87 and the inner circumferential surface 83A of the endless belt 83 in the section A1. This may thus reduce the frictional resistance caused between the sliding sheet 87 and the endless belt 83 when the endless belt 83 rotates.

Figure 6:
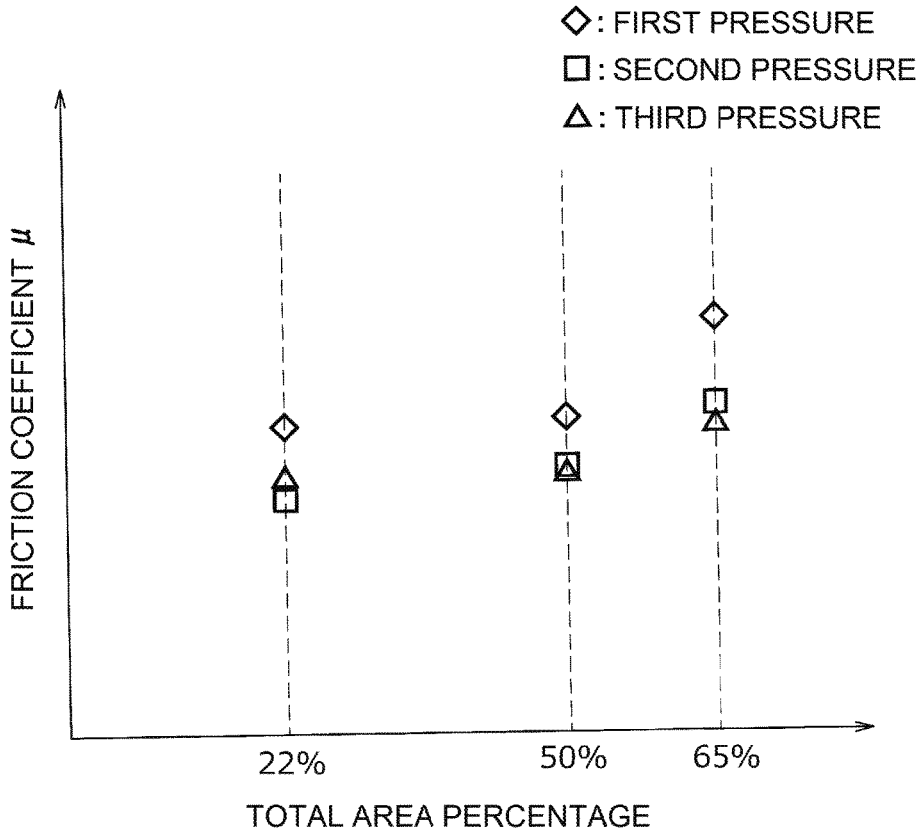
FIG. 6 is a graph showing a relationship between a total area percentage of particular portions of the sliding sheet and a friction coefficient in several examples of the illustrative embodiment according to one or more aspects of the present disclosure.

The particular portions of the surface F1 have the total area percentage of 50% or less relative to the area of the section A1 of the sliding sheet 87. This configuration may reduce a frictional coefficient μ of the sliding sheet 87 to the endless belt 83, as illustrated in FIG. 6. A graph shows frictional coefficients μ that occur under various conditions. Sliding sheets 87 of three types were used. The one type includes particular portions of the surface F1 whose total area percentage may be 22% relative to the area of the section A1 of the sliding sheet 87. Another type includes particular portions of the surface F1 whose total area percentage may be 50% relative to the area of the section A1 of the sliding sheet 87. The other type includes particular portions of the surface F1 whose total area percentage may be 65% relative to the area of the section A1 of the sliding sheet 87. In FIG. 6, symbols ◇, □, and Δ indicate respective conditions of pressure applied between the sliding sheet 87 and the endless belt 83. Symbol ◇ indicates the experimental result where a first pressure may be applied. Symbol □ indicates the experimental result where a second pressure greater than the first pressure may be applied. Symbol Δ indicates the experimental result where a third pressure greater than the second pressure may be applied. It is apparent from the experiment results that in all cases where the first, second, or third pressure may be applied, a smaller frictional coefficient μ occurs when the particular portions of the surface F1 of the sliding sheet 87 have a total area percentage of 50% or less relative to the area of the section A1 of the sliding sheet 87, as compared with a case where the particular portions of the surface F1 of the sliding sheet 87 have a total area percentage of 65% relative to the area of the section A1 of the sliding sheet 87.

Figure 7:
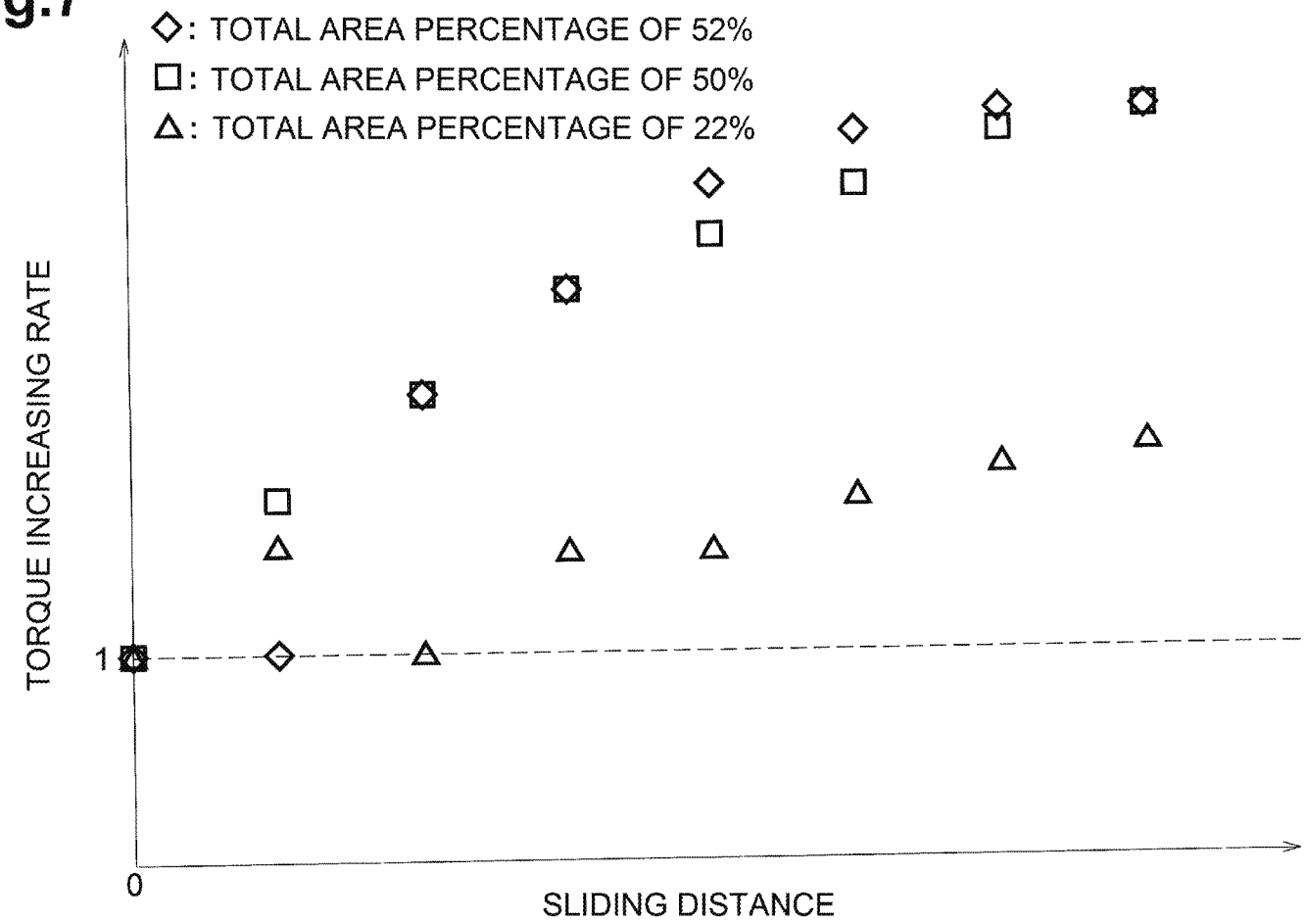
FIG. 7 is a graph showing durability of the sliding sheet according to a total area percentage in the illustrative embodiment according to one or more aspects of the present disclosure.

FIG. 7 shows experimental results related to a durability of the sliding sheet 87 according to the total area percentage of the particular portions of the surface F1 of the sliding sheet 87. Symbol ◇ indicates the experimental result where the particular portions of the surface F1 of the sliding sheet 87 have a total area percentage of 52% relative to the area of the section A1 of the sliding sheet 87. Symbol □ indicates the experimental result where the particular portions of the surface F1 of the sliding sheet 87 have a total area percentage of 50% relative to the area of the section A1 of the sliding sheet 87. Symbol Δ indicates the experimental result where the particular portions of the surface F1 of the sliding sheet 87 have a total area percentage of 22% relative to the area of the section A1 of the sliding sheet 87. It is apparent from the experiment results that, in a case where the particular portions of the surface F1 of the sliding sheet 87 have a total area percentage of 22% relative to the area of the section A1 of the sliding sheet 87, a motor might experience a relatively smaller increase in a torque increasing rate, although a sliding distance (total distance that the endless belt 83 travels over the sliding sheet) becomes greater. Consequently, to improve the durability of the sliding sheet 87, it may be preferable that the particular portions of the surface F1 of the sliding sheet 87 have a total area percentage of 22% or less.

While the disclosure has been described in detail with reference to the specific embodiment thereof, this is merely an example, and various changes, arrangements and modifications may be applied therein without departing from the spirit and scope of the disclosure. In the following alternative embodiments, an explanation will be given mainly for the parts different from the illustrative embodiment, and an explanation will be omitted for the common components by assigning the same reference numerals thereto.

In the illustrative embodiment, the opening E of each dimple C1 has a regular hexagonal shape. Nevertheless, in other embodiments, for example, the opening E of each dimple C1 may have another shape such as another hexagonal shape, any polygonal shape, or a circle. A polygonal opening of each dimple may have rounded corners. Hereinafter, alternative embodiments illustrate various dimples each having an opening having another shape.

Figure 8:
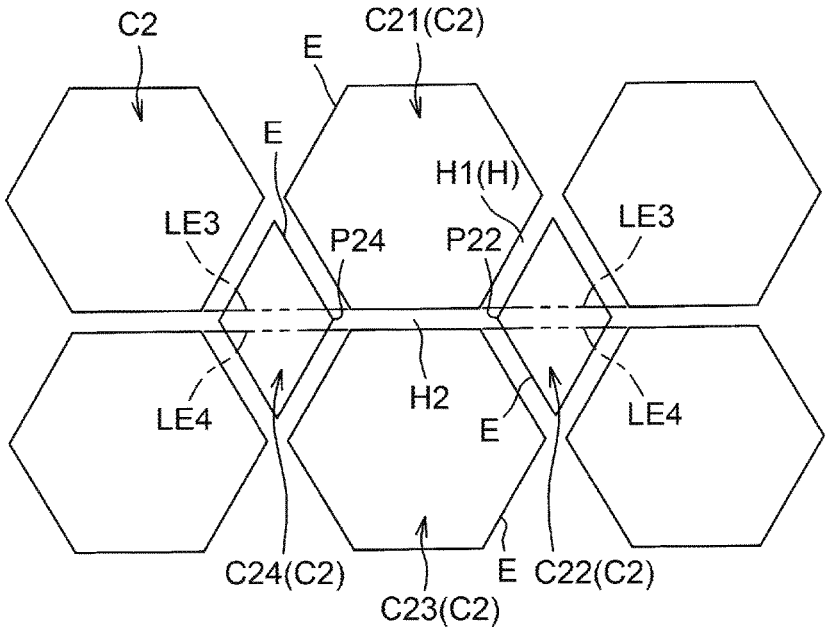
FIG. 8 is a plan view illustrating a plurality of dimples on a sliding sheet in a first alternative embodiment according to one or more aspects of the present disclosure.

In a first alternative embodiment, as illustrated in FIG. 8, a plurality of dimples C2 may be arranged in a regular pattern. The dimples C2 includes dimples C21, dimples C22, dimples C23, and dimples C24. The dimples C21 and the dimples C23 each have an opening E having a regular hexagonal shape. The dimples C22 and the forth dimples C24 each have an opening E having a quadrangular shape. The dimples C21 and the dimples C23 all have the same shape and size. The dimples C22 and the dimples C24 all have the same shape and size. Hereinafter, therefore, one each of the dimples C21, C22, C23, and C24 will be described in detail, and a description for the other will be omitted.

The surface F1 has a ridge H1 between a dimple C21 and a dimple C22. The surface F1 further has a ridge H2 between the dimple C21 and a dimple C23. Although not illustrated in FIG. 8, all imaginary straight lines L1 passing between dimples C22 and C21 and through the ridge intersect the dimple C23. All imaginary straight lines L2 passing between dimples C21 and C23 and through the ridge H2 intersect the dimple C24.

The opening E of each dimple C2 may have a width W of, for example, between 0.5 mm and 5 mm Each dimple C2 may have a depth of, for example, between 0.1 mm and 1 mm Each ridge H may have a width of, for example, between 0.1 mm to 1 mm.

The opening E of the dimple C22 has vertices including a vertex P22. The vertex P22 may be located closer to the ridge H2 than the other vertices of the opening E of the dimple C22 and may be located between an imaginary extension line LE3 and an imaginary extension line LE4. The imaginary extension line LE3 extends from a boundary between the dimple C21 and the ridge H2. The imaginary extension line LE4 extends from a boundary between the dimple C23 and the ridge H2. The opening E of the dimple C24 has vertices including a vertex P24. The vertex P24 may be located closer to the ridge H2 than the other vertices of the opening E of the dimple C24 and may be located between the imaginary extension line LE3 and the imaginary extension line LE4.

Figure 9:
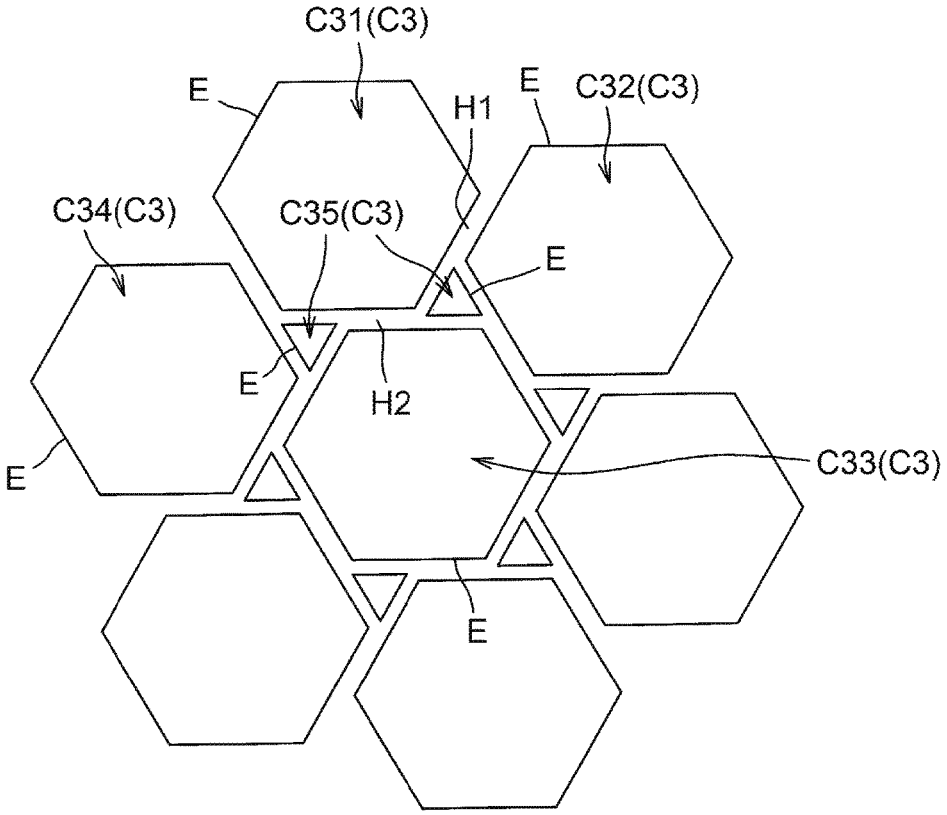
FIG. 9 is a plan view illustrating a plurality of dimples on a sliding sheet in a second alternative embodiment according to one or more aspects of the present disclosure.

In a second alternative embodiment, as illustrated in FIG. 9, a plurality of dimples C3 may be arranged in a regular pattern. The dimples C3 include dimples C31, dimples C32, dimples C33, dimples C34, and dimples C35. In this example embodiment, the dimples C31, the dimples C32, the dimples C33, and the dimples C34 each have an opening E having a regular hexagonal shape. The dimples C35 each have an opening E having a triangular shape. In this example embodiment, the dimples C31, the dimples C32, the dimples C33, and the dimples C34 all have the same shape and size. In this example embodiment, the dimples C35 all have the same shape and size. Hereinafter, therefore, an arbitrary one of each of the dimples C31, C32, C33, C34, and C35 will be described in detail, and a description for the other will be omitted. A dimple C31, a dimple C32, and a dimple C33 are located adjacent to each other. The dimple C31, the dimple C33, and the dimple C34 are located adjacent to each other.

The surface F1 has a ridge H1 between the dimple C31 and the dimple C32. The surface F1 further has a ridge H2 between the dimple C31 and the dimple C33. Although not illustrated in FIG. 9, all imaginary straight lines L1 passing between dimples C31 and C32 and through the ridge H1 intersect the dimple C33. All imaginary straight lines L2 passing between dimples C31 and C32 and through the ridge H2 intersect the dimple C34.

The opening E of each dimple C3 may have a width W of, for example, between 0.5 mm and 5 mm Each dimple C3 may have a depth of, for example, between 0.1 mm and 1 mm Each ridge H may have a width of, for example, between 0.1 mm to 1 mm Each dimple C35 may have edges each having a length of, for example, between 0.3 mm and 2 mm Each dimple C35 may have the same depth as the other dimples C31 to C34.

A dimple C35 may be located in a triangular area surrounded by the dimple C31, the dimple C32, and the dimple C33. Another dimple C35 may be located in another triangular area surrounded by the dimple C31, the dimple C33, and the dimple C44.

Figure 10:
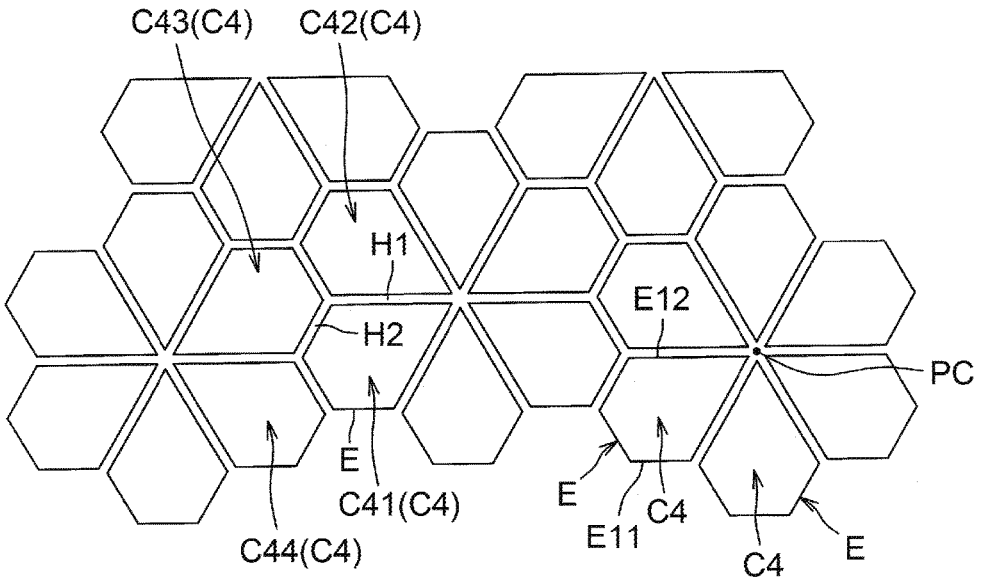
FIG. 10 is a plan view illustrating a plurality of dimples on a sliding sheet in a third alternative embodiment according to one or more aspects of the present disclosure.

In a third alternative embodiment, as illustrated in FIG. 10, a plurality of dimples C4 may be arranged in a regular pattern. Each dimple C4 has an opening E having a pentagonal shape. The dimples C4 all have the same shape and size. The opening E of each dimple C4 has three edges E11 each having a first length, and two edges E12 each having a second length longer than the first length. Six of the dimples C4 may be located on a circle having a center PC such that a vertex formed by the edges E12 of each of the six dimples C4 points to the center PC. This arrangement may enable the six dimples C4 to form a flower pattern. In other words, the six dimples C4 may be located in a petal arrangement. Such a flower pattern may be repeatedly arranged such that the flower patterns are located adjacent to each other while the edges E1 of the dimples C4 of adjacent flower patterns are next to each other.

The dimples C4 include dimples C41, dimples C42, dimples C43, and dimples C44. The dimples C41, the dimples C42, the dimples C43, and the dimples C44 all have the same shape and size. Hereinafter, therefore, arbitrary one of each of the dimples C41, C42, C43, and C44 will be described in detail, and a description for the other will be omitted. A dimple C41 and a dimple C42 are included in one of the flower patterns. A dimple C43 and a dimple C44 are included in another flower pattern located adjacent to the flower pattern including the dimple C41 and the dimple C42.

The surface F1 has a ridge H1 between the dimple C41 and the dimple C42. The surface F1 further has a ridge H2 between the dimple C41 and the dimple C43. Although not illustrated in FIG. 10, all imaginary straight lines L1 passing between dimples C41 and C42 and through the ridge H1 intersect the dimple C43. All imaginary straight lines L2 passing between dimples C41 and C43 and through the ridge H2 intersect the dimple C44.

Each dimple C4 may have a length of, for example, between 0.5 mm and 5 mm. The length may be measured between the two points that are farthest apart (e.g., between the vertex closest to the center PC and the edge farthest from center PC). Each dimple C4 may have a depth of, for example, between 0.1 mm and 1 mm Each ridge H may have a width of, for example, between 0.1 mm to 1 mm.

Figure 11:
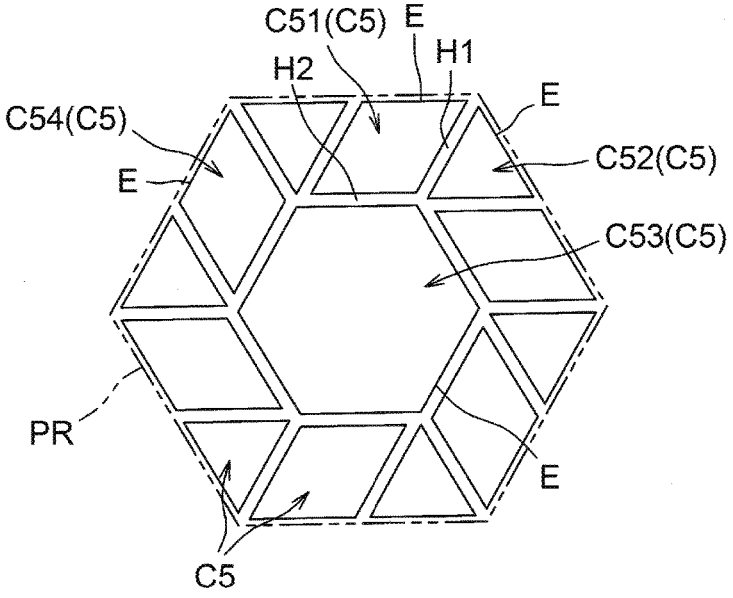
FIG. 11 is a plan view illustrating a plurality of dimples on a sliding sheet in a fourth alternative embodiment according to one or more aspects of the present disclosure.

In a fourth alternative embodiment, as illustrated in FIG. 11, a plurality of dimples C5 may be arranged in a regular pattern. The dimples C5 include dimples CM, dimples C52, dimples C53, and dimples C54. The dimples C51 and the dimples CM each have an opening E having a rhombus shape. The dimples C52 each have an opening E having a triangular shape. The dimples C53 each have an opening E having a hexagonal shape. Hereinafter, arbitrary one or more of each of the dimples CM, C52, C53, and CM will be described in detail, and a description for the other will be omitted.

The surface F1 has a ridge H1 between a dimple C51 and a dimple C52. The surface F1 further has a ridge H2 between the dimple C51 and a dimple C53. Although not illustrated in FIG. 11, all imaginary straight lines L1 passing between dimples C51 and C52 and through the ridge intersect the dimple C53. All imaginary straight lines L2 passing between dimples C51 and C53 and through the ridge H2 intersect the dimple CM.

Each of the dimple C51 and the dimple C52 has edges each having a length of, for example, 0.5 mm to 5 mm Each dimple C5 may have a depth of, for example, 0.1 mm to 1 mm Each ridge H may have a width of, for example, between 0.1 mm to 1 mm.

The dimples C5 include rhombus dimples C5 such as the dimples C51 and the dimples C54. A plurality of, for example, six, rhombus dimples C5 are located around a dimple C53 while one of the edges defining the opening E of each of the rhombus dimples C5 (e.g., the dimples C51 and C54) faces a corresponding one of edges of the dimple C53. The dimples C5 further include triangular dimples C5 such as the dimples C52. A triangular dimple C5 may be located between each of the rhombus dimples C5. That is, a plurality of, for example, six, triangular dimples C5 are located around a dimple C53. A combination of another of the edges defining the opening E of each rhombus dimple C5 and one of the edges defining the opening E of each triangular dimple C5 form an imaginary hexagonal pattern PR. The surface F1 may have a plurality of such imaginary hexagonal patterns PR arranged, for example, in a honeycomb lattice.

Figure 12:
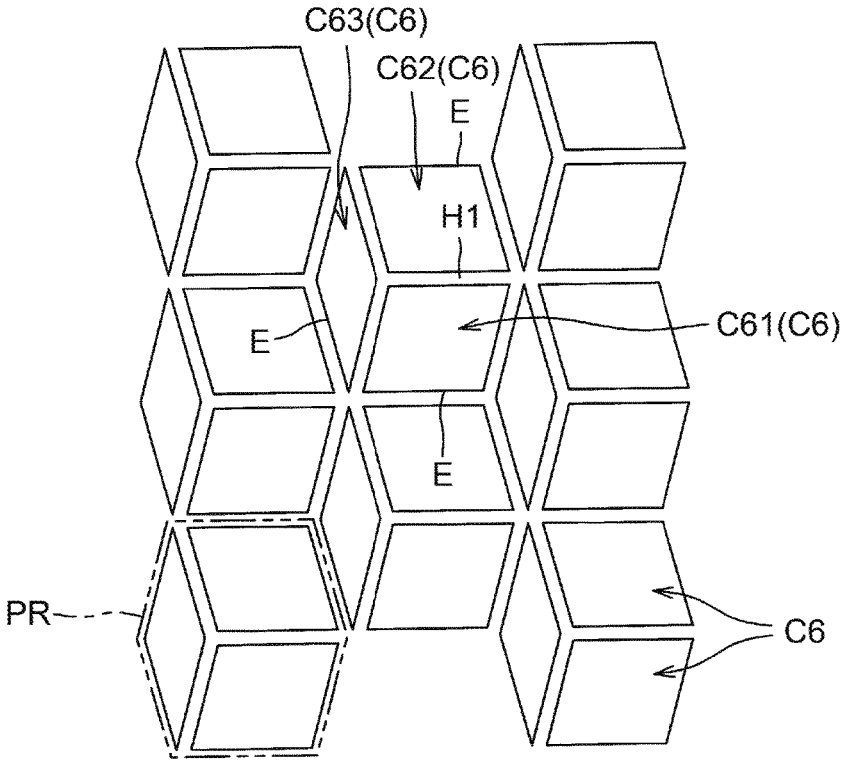
FIG. 12 is a plan view illustrating a plurality of dimples on a sliding sheet in a fifth alternative embodiment according to one or more aspects of the present disclosure.

In a fifth alternative embodiment, as illustrated in FIG. 12, a plurality of dimples C6 may be arranged in a regular pattern. The dimples C6 includes dimples C61, dimples C62, and dimples C63. The dimples C61 and the dimples C62 each have an opening E having a parallelogrammatic shape. The dimple C63 has an opening E having a rhombus shape. Hereinafter, arbitrary one of each of the dimples C61, C62, and C63 will be described in detail, and a description for the other will be omitted. The opening E of each of a dimple C61, a dimple C62, and a dimple C63 may be defined by respective edges. A combination of two each of the edges of each of the dimple C61, the dimple C62, and the dimple C63 form an imaginary hexagonal pattern PR. The surface F1 may have a plurality of such imaginary hexagonal patterns PR arranged, for example, in a honeycomb lattice.

The surface F1 has a ridge H1 between the dimple C61 and the dimple C62. Although not illustrated in FIG. 12, all imaginary straight lines L1 passing between dimples C61 and C62 and through the ridge H1 intersect the dimple C63.

Each of the dimples C6 has edges each having a length of, for example, 0.5 mm to 5 mm Each dimple C6 may have a depth of, for example, 0.1 mm to 1 mm Each ridge H may have a width of, for example, between 0.1 mm to 1 mm.

Figure 13:
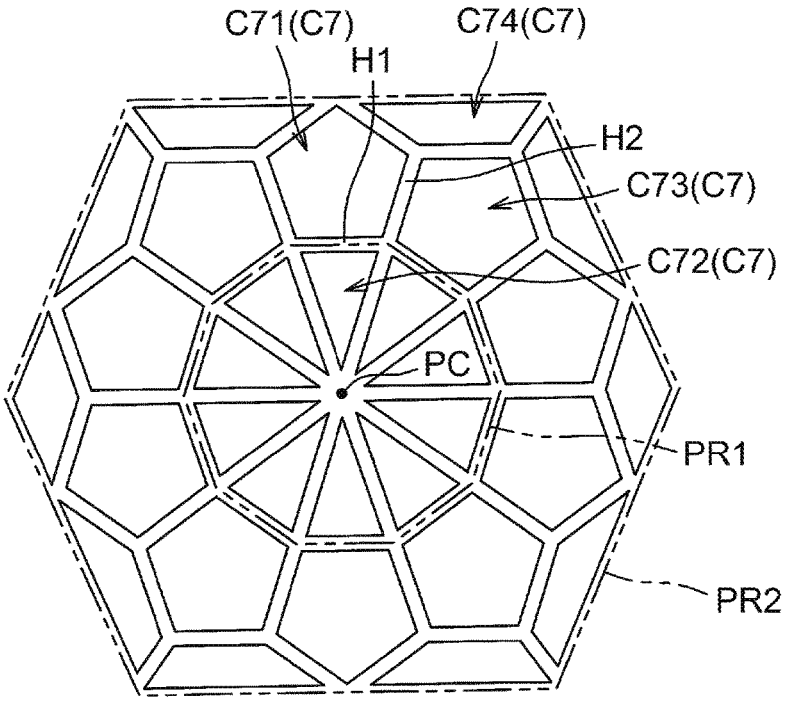
FIG. 13 is a plan view illustrating a plurality of dimples on a sliding sheet in a sixth alternative embodiment according to one or more aspects of the present disclosure.

In a sixth alternative embodiment, as illustrated in FIG. 13, a plurality of dimples C7 may be arranged in a regular pattern. The dimples C7 includes dimples C71, dimples C72, dimples C73, and dimples C74. The dimples C71 and the dimples C73 each have an opening E having a regular hexagonal shape. The dimples C72 has an opening E having an isosceles triangular shape. The dimples C74 has an opening E having a quadrangular shape. Hereinafter, arbitrary one or more of each of the dimples C71, the dimples C72, the dimples C73, and the dimples C74 will be described, and a description for the other will be omitted.

The surface F1 has a ridge H1 between a dimple C71 and a dimple C72. The surface F1 further has a ridge H2 between the dimple C71 and a dimple C73. Although not illustrated in FIG. 13, all imaginary straight lines L1 passing between dimples C71 and C72 and through the ridge H1 intersect the dimple C73. All imaginary straight lines L2 passing between dimples C71 and C73 and through the ridge H2 intersect the dimple C74.

Each of the dimple C71 and the dimple C73 has edges each having a length of, for example, 0.5 mm to 5 mm Each dimple C7 may have a depth of, for example, 0.1 mm to 1 mm Each ridge H may have a width of, for example, between 0.1 mm to 1 mm. The other dimples C72 and C74 each have any size and shape that satisfy a relationship between each of the regular hexagonal dimples C71 and C73 and the ridge H.

The dimples C7 includes isosceles triangular dimples C7 such as the dimples C72. A plurality of, for example, ten, isosceles triangular dimples C72 may be located on a circle having a center PC while a vertex formed by the longer edges of each of the ten dimples C72 points to the center PC. A combination of one (e.g., a base) of the edges defining the opening E of each isosceles triangular dimples C7 forms an imaginary decagonal pattern PR1.

The dimples C7 includes regular hexagonal dimples C7 such as the dimples C71 and the dimples C73. A plurality of, for example, ten, regular hexagonal dimples C7 may be located while one of the edges defining the opening E of each of the regular hexagonal dimples C7 faces the base of a corresponding one of the isosceles triangular dimples C7. The dimples C7 further include quadrangular dimples C7 such as the dimples C74. Each quadrangular dimple C7 may be located such that two of the edges of the opening E of the quadrangular dimple C7 each face a corresponding one of the edges of the opening E of each of the hexagonal dimples C7 located adjacent to each other. A combination of one or two of the edges defining the opening E of each quadrangular dimple C7 forms an imaginary hexagonal pattern PR2. The surface F1 may have a plurality of such imaginary hexagonal patterns PR2 arranged, for example, in a honeycomb lattice.

Figure 14:
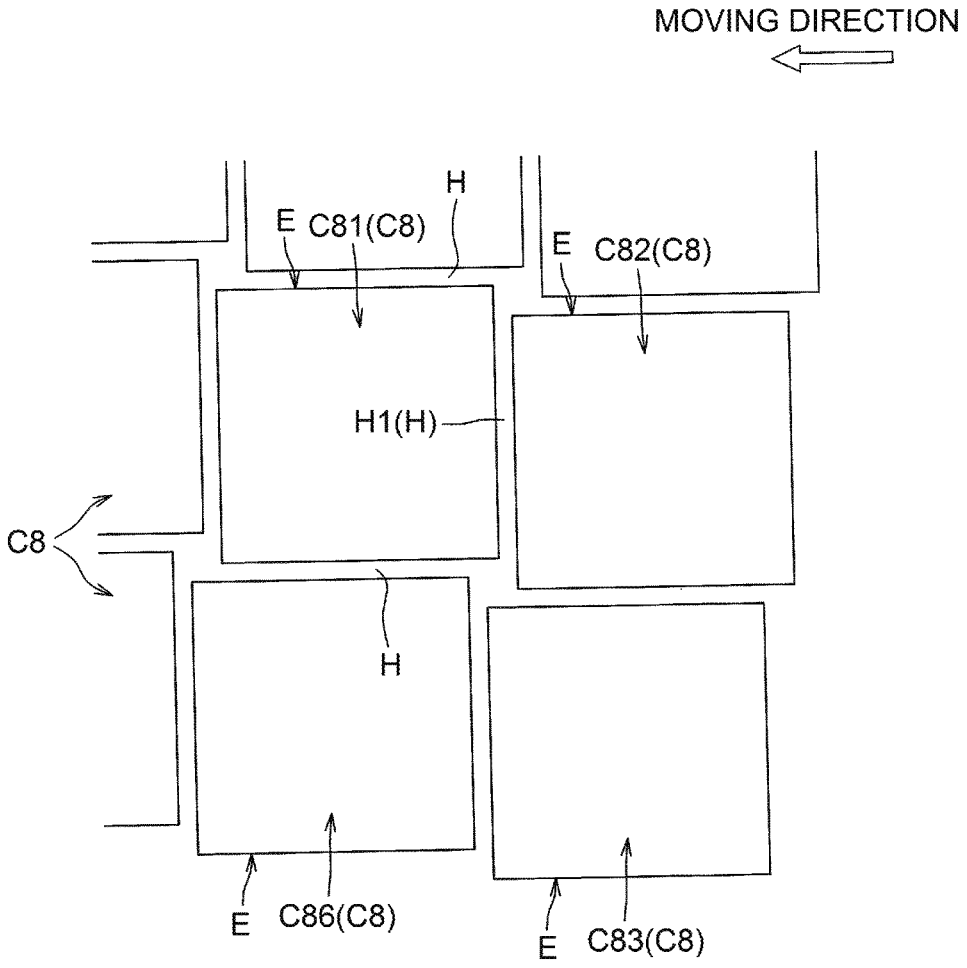
FIG. 14 is a plan view illustrating a plurality of dimples on a sliding sheet in a seventh alternative embodiment according to one or more aspects of the present disclosure.

In a seventh illustrative embodiment, as illustrated in FIG. 14, a plurality of dimples C8 may be arranged in a regular pattern. Each dimple C8 has an opening E having a square shape. The dimples C8 all have the same shape and size. The dimples C8 may be offset relative to each other with respect to both the moving direction and the width direction.

The dimples C8 includes dimples C81, dimples C82, dimples C83, and dimples C86. Hereinafter, arbitrary one of each of the dimples C81, the dimples C82, the dimples C83, and the dimples C86 will be described in detail, and a description for the other will be omitted. A dimple C82 may be located upstream from a dimple C81 in the moving direction while being offset relative to the dimple C81 in the width direction. The offset amount of the dimple C82 relative to the dimple C81 may be greater than the width of a ridge H. A dimple C83 may be located adjacent to the dimple C82 in the width direction while being offset relative to the dimple C82 in the moving direction. The offset amount of the dimple C83 relative to the dimple C82 may be greater than the width of a ridge H. A dimple C86 may be located downstream from the dimple C83 in the width direction while being offset relative to the dimple C83 in the width direction. The offset amount of the dimple C86 relative to the dimple C83 may be greater than the width of the ridge H.

The surface F1 has a ridge H1 between the dimple C81 and the dimple C82. Although not illustrated in FIG. 14, all imaginary straight lines L1 passing between dimples C81 and C82 and through the ridge H1 intersect the dimple C83.

Dimple groups each including four dimples C81, C82, C83, and C86 having the above relationship may be arranged in a regular pattern. This may achieve the following effects. If some of lubricant supplied from the dimple C82 moves further from either or both ends of the ridge H1 in the width direction, the lubricant may move along ridges H that are located adjacent to the dimple C81 in the width direction and extend in the moving direction. The lubricant may be thus caught by dimples C8 located downstream from the ridges H in the moving direction. Such an arrangement pattern may therefore enable each dimple C8 to retain lubricant therein sufficiently.

Each of the dimples C8 has edges each having a length of, for example, 0.5 mm to 5 mm Each dimple C8 may have a depth of, for example, 0.1 mm to 1 mm Each ridge H may have a width of, for example, between 0.1 mm to 1 mm.

In the illustrative embodiment, the ridge H1 extends along the width direction. Nevertheless, in other embodiments, for example, the ridge H1 may extend along the moving direction or may be angled to the width direction.

In the illustrative embodiment, the halogen lamp may be used as the heater 82. Nevertheless, in other embodiments, for example, a carbon heater may be used as the heater 82.

In the illustrative embodiment, the pressure pad 85 that may be an elastic member made of, for example, rubber, is used as the nip forming member. Nevertheless, in other embodiments, for example, the nip forming member may have a plate shape and be made of rigid material such as resin, plastic or metal that might not be elastically deformable under application of pressure. The nip forming member and the holder 86 may have a one-piece structure and may be inseparable. Nevertheless, the use of the rigid nip forming member may cause increase of the sliding resistance between the sliding sheet and the endless belt by flatten dimples in the surface of the sliding sheet due to long-term use of the sliding sheet and/or cause deterioration of image quality by impressions of the dimple patterns of the sliding sheet on the endless belt. For those reasons, it may be preferable that the nip forming member include an elastic member such as rubber that may be elastically deformable in response to the dimple patterns of the sliding sheet under pressure. In the illustrative embodiment, each dimple has a pyramid shape. Nevertheless, in other embodiments, for example, each dimple may have a truncated pyramid shape or a spherical shape.

In the illustrative embodiments, the heat roller 81 including the heater 82 in its internal space may be used as the rotatable member. Nevertheless, in other embodiments, for example, an endless belt whose inner circumferential surface may be heated by a heater may be used as the rotatable member. In another example, a heater may be disposed outside the rotatable member and may heat an outer circumferential surface of the rotatable member. In still other example, an induction heating ("IH") method may be used. In yet another example, a heater may be disposed inside the loop of the endless belt and may indirectly heat a rotatable member contacting the outer circumferential surface of the endless belt. In still yet another example, a rotatable member and an endless belt each may include a heater in its internal space.

In the illustrative embodiment, the fuser 8 includes the configuration for forming a nip portion. Nevertheless, in other embodiments, for example, another device or unit, for example, a sheet conveying system, may include such a configuration. For example, the configuration of the disclosure may be applied to a sheet conveying system that includes conveying rollers and a sheet conveying belt for conveying a sheet. More specifically, for example, the configuration of the disclosure may be provided inside a loop of the sheet conveying belt.

The configuration for forming a nip portion may be not limited to the specific example (e.g., the fuser 8). In other embodiments, for example, a fuser may include a fusing roller, a pressure roller for forming a nip portion together with the fusing roller, and a heat unit for contacting the fusing roller with a predetermined nip pressure to heat the fusing roller. The fuser may be configured to fuse a toner image onto a sheet at the nip portion. Such a fuser may include the configuration according to the disclosure in the heat unit. More specifically, for example, in a case where the heat unit includes an endless belt, and a heat member that sandwiches the endless belt with the fusing roller, a sliding sheet may be provided between the heat member and the endless belt.

In the illustrative embodiment and the alternative embodiments, the disclosure has been applied to the laser printer 1. Nevertheless, in other embodiments, for example, the disclosure may be applied to other image forming apparatuses, such as copying machines and multifunction devices.

The one or more aspects of the disclosure may be implemented in various combinations of the elements described in the illustrative embodiments and alternative embodiments.

What is claimed is:

1. A fuser comprising:

a rotatable member;

a belt comprising:

an inner peripheral surface; and an outer peripheral surface facing the rotatable member;

a heater arranged to heat the rotatable member;

a pressure member configured to, with the rotatable member, sandwich the belt to form a nip portion; and a sliding member comprising a portion sandwiched between the inner peripheral surface of the belt and the pressure member at a position corresponding to the nip portion, the sliding member comprising a front surface facing the inner peripheral surface of the belt and a back surface facing the pressure member, wherein the front surface comprises a plurality of dimples which are arranged at a predetermined area corresponding to at least part of the nip portion, the plurality of dimples comprising:

a first dimple;

a second dimple adjacent to and spaced from the first dimple to form a first ridge portion between the first dimple and the second dimple; and a third dimple arranged to intersect all imaginary first lines passing between the first dimple and the second dimple and through the first ridge portion without intersecting the first dimple or the second dimple.

2. The fuser according to claim 1, wherein the third dimple is adjacent to and spaced from the first dimple to form a second ridge portion between the first dimple and the third dimple, and wherein the plurality of the dimples further comprises a fourth dimple arranged adjacent to the third dimple, the fourth dimple arranged to intersect all imaginary second lines passing between the first dimple and the third dimple and through the second ridge portion.

3. The fuser according to claim 1, wherein each of the first, second, and third dimples has a polygonal shape opening.

4. The fuser according to claim 3, wherein the third dimple intersects both a first borderline between the first dimple and the first ridge portion and a second borderline between the second dimple and the first ridge portion.

5. The fuser according to claim 4, wherein the third dimple forms a hexagon opening and comprises a plurality of vertices including a first vertex which is a closer to the first ridge portion than the other vertices of the third dimple, and wherein the first vertex is positioned between the first borderline and the second borderline.

6. The fuser according to claim 5, wherein each of the first, second, and third dimples has a regular hexagonal shape opening, and wherein each of the first dimple and the second dimple intersects an imaginary straight line perpendicular to the first borderline and passing through the first vertex.

7. The fuser according to claim 1, wherein the first ridge portion extends in a direction parallel to a rotational axis of the rotatable member.

8. The fuser according to claim 1, wherein the front surface comprises a contact surface in contact with the inner peripheral surface at the position corresponding to the nip portion, and wherein a total area percentage of the contact surface is equal to or less than 50% of the front surface at the position corresponding to the nip portion.

9. The fuser according to claim 2, wherein each of the first and third dimples has a hexagon shape opening, and wherein each of the second and fourth dimples has a quadrangle shape opening.

10. The fuser according to claim 9, wherein the second dimple comprises a first vertex which is a closest vertex to the second ridge portion among all vertices of the second dimple, the first vertex being positioned between a first borderline which comprises a first boundary defined between the first dimple and the second ridge portion and a second borderline which includes a second boundary defined between the third dimple and the second ridge portion, and wherein the fourth dimple comprises a plurality of vertices comprising a second vertex which is closer to the second ridge portion than the other vertices of the fourth dimple, the second vertex being positioned between the first borderline and the second borderline.

11. The fuser according to claim 1, wherein each of the first, second, and third dimples has a hexagonal shape opening, and wherein the plurality of dimples comprises a fourth dimple adjacent to the first, second, and third dimples and has a triangle shape opening.

12. The fuser according to claim 3, wherein each of the first, second, and third dimples has a pentagonal shape opening.

13. The fuser according to claim 1, wherein each of the first and second dimples has a parallelogram shape opening and the third dimple has a rhombus shape opening.

14. The fuser according to claim 1, wherein the first, second, and third dimples have different shapes from each other.

15. The fuser according to claim 1, wherein the pressure member comprises an elastic pad.

16. The fuser according to claim 1, wherein the rotatable member comprises a roller, and wherein the heater is disposed in an interior space of the roller.

17. The fuser according to claim 1, wherein the inner peripheral surface has lubricant applied thereon.

18. The fuser according to claim 1, wherein a diameter of an imaginary inscribed circle that is tangent to each edge of the first dimple is greater than a width of the first ridge portion.

19. A fuser comprising:

a rotatable member;

a belt comprising:

an inner peripheral surface; and an outer peripheral surface facing the rotatable member;

a heater arranged to heat the rotatable member;

a pad configured to form a nip portion between the rotatable member and the outer peripheral surface of the belt; and a sliding member comprising a portion sandwiched between the inner peripheral surface of the belt and the pad at a position corresponding to the nip portion, the sliding member comprising a front surface facing the inner peripheral surface of the belt and a back surface facing the pad, wherein the front surface comprises a plurality of dimples arranged in a honeycomb lattice at a predetermined area corresponding to at least part of the nip portion, each of the dimples having a hexagonal shape opening.

20. The fuser according to claim 19, wherein the front surface comprises a contact surface in contact with the inner peripheral surface at the position corresponding to the nip portion, and wherein a total area percentage of the contact surface is equal to or less than 50% of the front surface at the position corresponding to the nip portion.

* * * * *